United States Patent [19]

Hauber

[11] Patent Number: 4,457,052

[45] Date of Patent: Jul. 3, 1984

[54] BUCKLE FOR CHILD'S CAR SEAT HARNESS

[76] Inventor: Peter Hauber, 9001 N. Glenoaks, Sun Valley, Calif. 91352

[21] Appl. No.: 350,303

[22] Filed: Feb. 19, 1982

[51] Int. Cl.[3] ..... A44B 11/26; A44B 11/00

[52] U.S. Cl. ..... 24/656; 24/664; 24/697

[58] Field of Search ..... 24/230 AK, 230 AL, 211 L, 24/230 R, 230 A, 230 BC, 230 TC, 230 AD, 230 AS, 230 AT; 297/216

[56] References Cited

U.S. PATENT DOCUMENTS

| | | | |
|---|---|---|---|
| 2,882,581 | 4/1959 | Spielman | 24/230 R |
| 2,927,814 | 3/1960 | Reitzel | 24/230 AL |
| 3,594,872 | 7/1971 | Kulwin et al. | 24/230 R |
| 3,673,645 | 7/1972 | Burleigh | 24/203 R |
| 3,728,764 | 4/1973 | Carter | 24/230 AK |
| 3,925,853 | 12/1975 | Nicklin | 24/230 AK |
| 3,932,917 | 1/1976 | Dobelmann | 24/230 A |
| 3,963,090 | 6/1976 | Hollins | 24/230 A |
| 3,969,795 | 7/1976 | Stephenson | 24/230 A |
| 4,122,584 | 10/1978 | Fohl | 24/230 A |
| 4,343,510 | 8/1981 | Cone | 297/216 |
| 4,392,280 | 7/1983 | Gavagan | 24/230 A |

*Primary Examiner*—Paul J. Hirsch

*Attorney, Agent, or Firm*—Wagner & Bachand

[57] ABSTRACT

An improved buckle for a child's safety car seat in which a release plate normally bears against a center plate, within an enclosing housing, to receive in locking relation hasp tips having opening cooperating with bosses on the release plate. The housing is configured to avoid cocking or blocking of the hasp tips on insertion, and to bias the housing covering the bail portion of the buckle against peeling away to expose the metal to the harness straps connecting the buckle to the child's car seat.

14 Claims, 6 Drawing Figures

BUCKLE FOR CHILD'S CAR SEAT HARNESS

Technical Field

This invention has to do with buckle structures, and more particularly with improved buckle structures for child's safety car seat harnesses which are positive-locking, firmly and uniformly spring-loaded and release button-shrouded against inadvertent or child release, and yet easy to couple and decouple by virtue of interior configuration features for prevention of snagging of latch tips within the buckle and possible cocking rather than locking as a result. The buckle moreover is provided with harness wear preventing features for long, safe use.

Background Art

Children at the toddler age are desirably restrained while being transported by car for the dual reasons of safety against collision with the car interior in the event of a sudden stop, and to avoid distractions to and interference with the driver. For this purpose, child car seats have been developed over the years from simple canvas seats on a metal frame to elaborate molded structures which substantially enclose the child, sometimes facing rearwardly. Childs' safety seats today use some form of harness strapping to hold the child within the seat. These harnesses are comprised of intersecting belts which extend around and from the seat structure proper about the child. Such harnesses must be loose enough that the child is comfortable, but tight enough that the child is effectively restrained within the seat. For such purposes the harnesses are typically adjustable by harness strap length adjustment. The adjusted straps are separably connected, usually at the child's midsection by the use of a buckle.

Federal standards have been promulgated to ensure the efficacy of child safety seats, and products have been introduced to meet those standards. Among the most successful products are those employing a buckle having a rigid housing, a metal plate enclosed by the housing and defining a bail to which one harness strap is connected, the plate being apertured, a hasp member to which another strap is attached having an opening adapted to selectively register with the plate aperture, a spring loaded release plate carrying a boss which selectively projects through the plate aperture to interfit with the hasp openings buckling the hasp to the buckle and surrounding the child with straps, and a button enshrouded against inadvertent movement and adapted to displace the release boss from interfittment with the hasp opening, the button extending normal to the planes of the hasp and plate.

Description of the Invention

It is therefore an object of the invention to provide an improved child's safety car seat, particularly an improved buckle structure therefor.

This and other objects of the invention to become apparent hereinafter are realized in a child's car safety seat comprising a chair body in which the child sits, a harness anchored to the chair body and adapted to encircle a seated child therein, the harness comprising strap means having opposed free ends, and buckle means for connecting the strap free ends, the buckle means comprising a hasp atttached to one strap free end and defining an opening beyond the strap free end, and a buckle on the opposite strap free end, the buckle comprising a rigid housing adapted to endwise receive the hasp, and within the housing parallel to the plane of hasp reception a center plate having a bail portion attached to the opposite strap and a central aperture therebeyond with which the hasp opening is adapted to register in the assembled relation of the buckle means, a release plate parallel to the center plate and defining a boss adapted to protrude through the center plate aperture and slope-surfaced to readily be received into the hasp opening under spring bias on the release plate to secure the hasp in the buckle housing; button means carried by the housing to shift the release plate relatively away from the center plate against the spring bias in hasp releasing relation, the button means being T-shaped in cross-section and interiorly void in both leg and shoulder portions.

In particular embodiments, the housing includes an extended portion substantially enclosing the center plate bail portion, and also a housing relatively enlarged transverse shoulder adjacent its extended portion blocking separation of the housing portion from the plate bail; the housing comprises matching oppositely recessed halves perimetrically joined in center plate securing relation, one of the halves defining a slot into which the hasp is receivable, and also a champfer on the housing interior wall opposite the slot against contact of the hasp with the housing wall in cocking or blocking relation to the release plate boss; there may also be provided a plurality of hasps having boss-receiving openings, and a corresponding plurality of bosses on the release plate, each sloped to cam the hasp therepast on housing half slot reception; and typically the housing defines a plurality of symmetrically arranged spring sockets in a common plane parallel to the center plate, and there is included also a plurality of compression springs seated in the pockets and arranged to bias the release plate resiliently into contact with the center plate, the springs being overcome by cam pressure on the bosses by a hasp inserted into the housing slot.

In a particularly preferred embodiment, the child's car safety seat comprises a chair body in which the child sits, a harness anchored to the chair body and adapted to encircle a seated child therein, the harness comprising strap means having opposed free ends, and buckle means for connecting the strap free ends, the buckle means comprising a hasp attached to one strap free end and having a tip defining an opening beyond the strap free end, and a buckle on the opposite strap free end, the buckle comprising a rigid housing adapted to endwise receive the hasp tip, and within the housing parallel to the plane of hasp reception a center plate having a bail portion covered by an extended portion of the housing and attached to the opposite strap, the center plate also having a central aperture beyond the bail with which the hasp tip opening is adaped to register in the assembled relation of the buckle means, a release plate parallel to the center plate and defining a boss adapted to protrude through the center plate aperture and slope-surfaced to readily be received into the hasp opening under spring bias on the release plate to secure the hasp in the buckle housing; and button means carried by the housing to shift the release plate relatively away from the center plate against the spring bias in hasp releasing relation, the housing defining transversely to its extended portion an enlarged shoulder biasing the housing extended portion in plate bail portion separating blocking relation.

In this embodiment, features include: the button being T-shaped, having an enlarged top for easy depression, housing-defined means surrounding the top against inadvertent depression, and a central leg in contact with the release plate in hasp tip passing relation and adjacently spaced relative to the boss, the top and the leg being interiorly void; the center plate is metal, the housing comprises smooth plastic, the housing extended portion substantially encloses the center plate bail portion against strap fraying contact with the bail, and also a housing relatively enlarged transverse shoulder adjacent its extended portion blocking separation of the housing portion from the plate bail and thus exposure of the strap to fraying contact; the housing comprises matching oppositely recessed molded halves perimetrically engaged and distributively pinned together in center plate securing relation, one of the halves defining a slot into which the hasp tip is receivable, and including also a champfer on the housing interior wall opposite the slot against contact of the hasp tip with the housing wall in cocking or blocking relation to the release plate boss; a plurality of hasp tips having boss-receiving openings, and a corresponding plurality of bosses on the release plate, each sloped to cam the hasp therepast on housing half slot reception; the hasp tips are carried on a common hasp or are defined by individual, separate hasps attached to respectively different straps for joint entry into the housing slot; the hasp tips are acutely angled relative to the remainder of the hasp, and also a relief at the juncture of the tip and the hasp; the housing definces a plurality of symmetrically arranged spring sockets in a common plane parallel to the center plate, and includes also a plurality of compression springs seated in the pockets and arranged to bias the release plate resiliently into contact with the center plate, the springs being overcome by cam pressure on the bosses by a hasp inserted into the housing slot.

The Drawings

The invention will be further described as to an illustrative embodiment in conjunction with the attached drawings in which.

Preferred Modes

Figure 1:
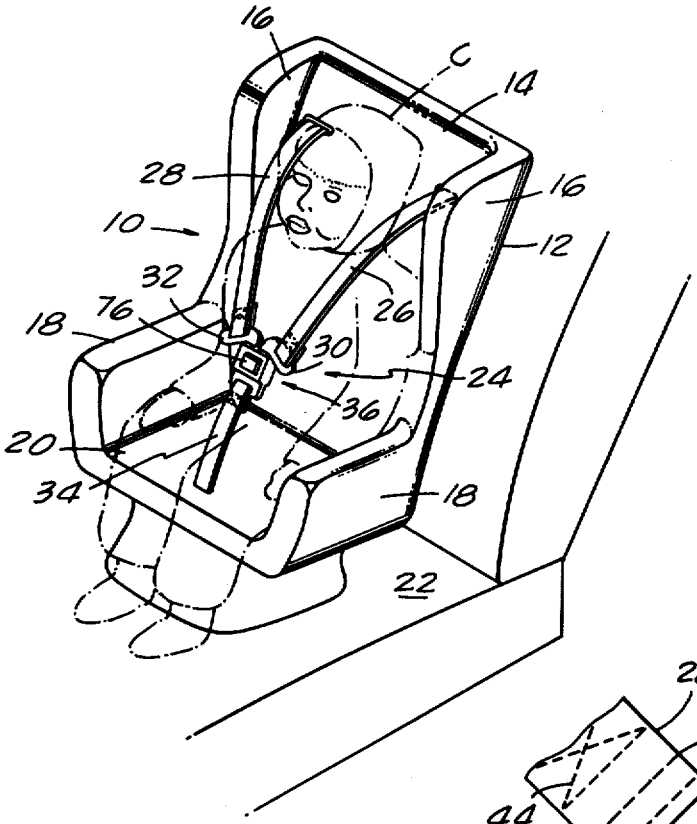
FIG. 1 is a perspective view of the child's car safety seat with the harness and buckle thereon according to the invention.

Turning now the drawings in detail, in FIG. 1 there is shown a child's safety car seat 10 comprising a molded plastic pedestle body 12 defining a back 14, wings 16, arms 18, and a seat portion proper, 20. As is conventional, the seat 10 rests on the usual adult-sized car seat 22, secured thereby means such as factory equipped seat belts, not shown. The child C, shown in phantom, is secured in the car seat 10 by a harness 24, comprising right over-the-shoulder strap 26 and a left over-the-shoulder strap 28. Each of straps 26, 28 terminate in an acute angle hasp 30, 32, as will be explained subsequently. A single hasp having two tips can also be used. A between-the-legs strap 34 is brought up from the seat 20 to meet the straps 26, 28, as shown. Strap 34 terminates in a buckle 36.

Figure 2:
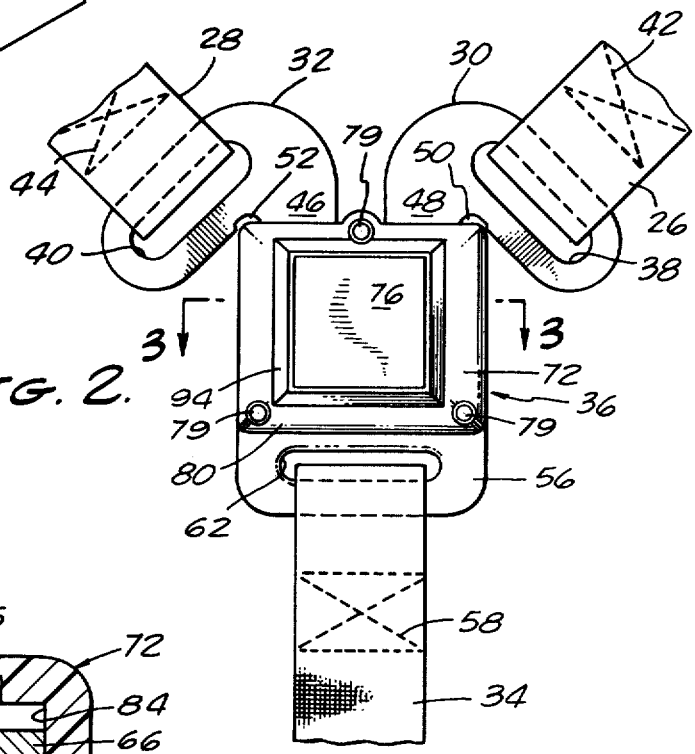
FIG. 2 is a plan view of the improved buckle and hasp structure.
Figure 3:
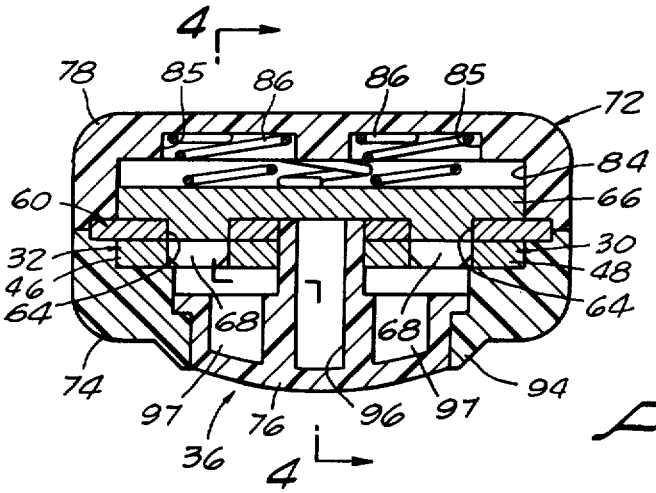
FIG. 3 is a transverse section view taken on line 3—3 in FIG. 2.
Figure 4:
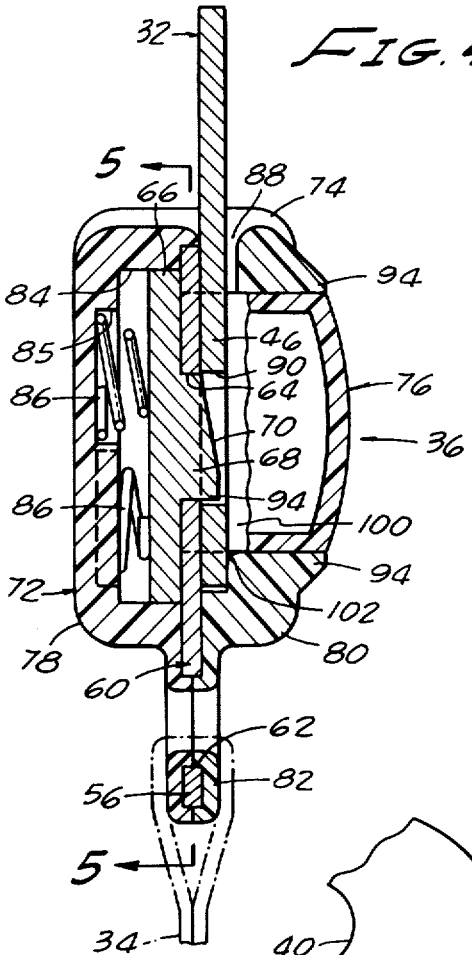
FIG. 4 is a stepped longitudinal section view taken on line 4—4 in FIG. 3 showing the buckle and hasp buckled.
Figure 5:
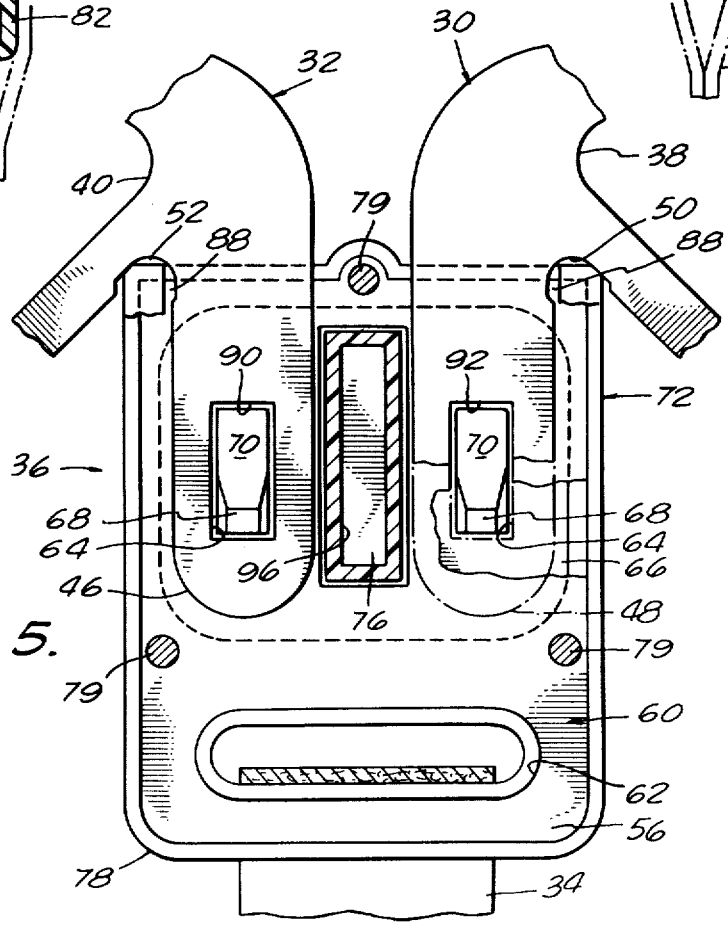
FIG. 5 is vertical section view taken on line 5—5 in FIG. 4.

With particular reference to FIGS. 2 through 6, the hasps 30, 32 are secured to the terminals of straps 26, 28 by passing the strap through slots 38, 40, doubling the strap over and sewing as at 42, 44 or otherwise fastening the strap to itself with the hasp secured in the loop formed by the strap. The hasp tips 46, 48 are at an acute angle to the remainder of the hasps 30, 32. It has been found that relief of the junctures 50, 52 by forming an enlarged inner wall radius there as shown in FIGS. 2 and 5 particularly, contributes importantly to the effective operation of the buckle and hasp in securely fastening the straps together as will be explained.

The strap 34 is similarly secured to bail 56 of buckle 36, by folding over and stiching at 58.

Figure 6:
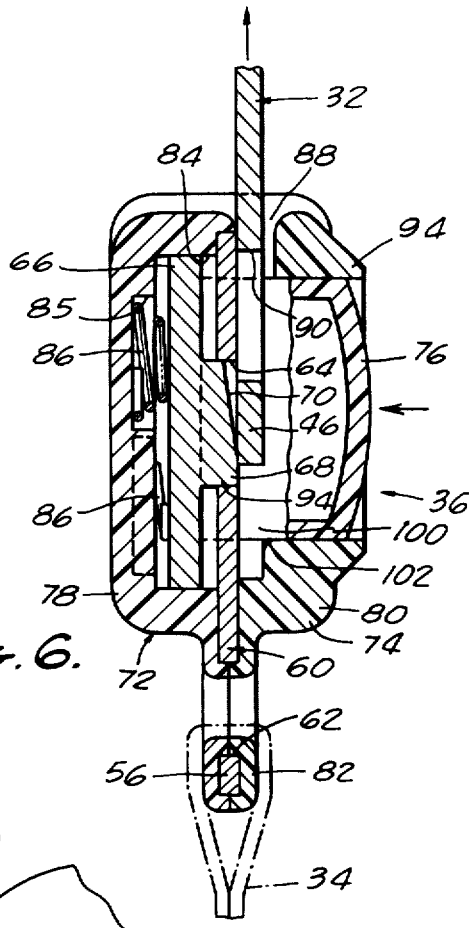
FIG. 6 is a view like FIG. 4, but showing the release plate depressed for unbuckling the buckle and hasp.

The buckle 36 is seen to comprise a center plate 60, having, as best shown in FIG. 5 a bail 56-forming cut-out 62 at one end, and a pair of parallel apertures 64 at the opposite end thereof. The strap 34 is anchored by the bail 56. A release plate 66 lies parallel to and normally against center plate 60. Release plate 66, best shown in FIGS. 4 and 6, is generally flat but has a pair of up-raised bosses 68 formed thereon, positioned to be received in and sized to protrude through the center plate apertures 64, which are of congruent rectangular configuration in horizontal cross-section. Importantly, the bosses 68 are shaped in vertical cross-section to define a camming, sloped surface 70 toward hasp tip 46, 48 receiving slot 88 for purposes to appear.

The center plate 60 and release plate 66 are metal and located within a rigid plastic housing 72 composed of a first molded half 74 centrally apertured to journal push-button 76, and a mating second molded half 78 perimetrically engaging the first half. Three rivets 79 hold the housing halves 74, 78 together. It will be observed that housing halves 74, 78 are shaped to be congruent with the center plate 60, covering that plate at all points, including in the region of the bail 56. The first housing half 74 is formed with a relatively enlarged shoulder 80 which has been found effective to block pull-back of the half portion 82 overlying the bail 56. In the absence of this relatively enlarged shoulder 80, the molded housing half 74 may curl or warp, exposing the center plate 60 in the area of strap 34, permitting the strap to rub on the metal of cut-out 62 rather than on the smooth plastic of the housing 72. The presence of the indicated relatively enlarged shoulder 80 ameliorates this problem.

Second housing half 78 defines a stepped bore 84 in which release plate 66 is guided for vertical movement. The lower portion of the bore 84 is divided into pockets 85 for compression springs 86, three in number for symmetrical force against the release plate 66. As will be evident, springs 86 urge the release plate 66 against the center plate 60 so that the bosses 68 protrude through apertures 64, the height of the bosses being greater than the thickness of the center plate 60, as shown. First housing half 74 defines slot openings 88 into which hasp tips 46, 48 are insertable.

With particular reference to FIGS. 4 and 6, in use of the buckle 36, the hasp tips 46, 48 are pushed through slot openings 88. The tips 46, 48 initially engage the sloped surfaces 70 of the release plate bosses 68 camming the release plate 66 away from the center plate 60 against the force of springs 86, until openings 90, 92 in the hasp tips overlie the bosses, whereupon the bosses snap into the openings, the boss shoulders 94 engaging the opening and blocking reverse movement so long as the release plate is in contact with the center plate. Hasp reliefs 50, 52 insure full seating of the hasps 30, 32 and strength in the assembly.

Release of the buckle 36 is accomplished by depressing button 76, protectively enclosed by housing shroud 94 against inadvertent or child pushing, and by the leg 96 portion of the T-shaped push-button driving the release plate 66 from the center plate 60, and the bosses 68 from the hasp tip openings 90, 92. It is noteworthy that the wide button 76 provides good area for pushing, needed against the stiff springing used to insured good locking of the hasps 30, 32 into the buckle 36, and that the camming surfaces 70 of the bosses 68 ease the entry of the hasp tips 46, 48 as well, all while maintaining substantial positive locking as contemplated by federal standards for car safety seats. In addition the button 76 is interiorly void in both the leg 96 and shoulder portions 97 so that adequate rigidity without shrinkage or distortion in the molding thereof may be realized, and the button operate smoothly without hanging up.

Within the housing first half 74, the interior cavity 100 is champfered at 102 opposite the incoming hasp tips 46, 48 to avoid cocking or blocking interference of the cavity wall as the hasps 30, 32 are inserted, which might otherwise occur with possible loss of full engagement of the hasp tip opening 90, 92 with its cooperating boss 68.

I claim:

1. In a child's car safety seat comprising a chair body in which the child sits, a harness anchored to the chair body and adapted to encircle a seated child therein, the harness comprising strap means having opposed free ends, and buckle means for connecting said strap free ends, said buckle means comprising a hasp attached to one strap free end and defining an opening beyond said strap free end, and a buckle on the opposite strap free end, said buckle comprising a rigid housing adapted to endwise receive said hasp, and within said housing parallel to the plane of hasp reception a center plate having a bail portion attached to said opposite strap and a central aperture therebeyond with which said hasp opening is adapted to register in the assembled relation of said buckle means, a generally flat release plate parallel to said center plate and defining a boss adapted to protrude through said center plate aperture and slope-surfaced to readily be received into said hasp opening under symmetrical spring bias against said release plate from spring means laterally and vertically offset from said boss to secure said hasp in said buckle housing; button means carried by said housing having a vertical portion parallel to said boss and in passing relation thereto adapted to shift said release plate relatively away from said center plate against said spring bias in hasp releasing relation.

2. The child's car safety seat according to claim 1, in which said housing includes an extended portion substantially enclosing said center plate bail portion, and including also a housing relatively enlarged transverse shoulder adjacent its extended portion blocking separation of said housing portion from said plate bail.

3. The child's car safety seat according to claim 1, in which said housing comprises matching oppositely recessed halves perimetrically joined in center plate securing relation, one of said halves defining a slot into which said hasp is receivable, and including also a chamfer on the housing inerior wall opposite said slot against contact of said hasp with the housing wall in cocking or blocking relation to the release plate boss.

4. The child's car safety seat according to claim 3, including also a plurality of hasps having boss-receiving openings, and a corresponding plurality of bosses on said release plate, each sloped to cam said hasp therepast on housing half slot reception.

5. The child's car safety seat according to claim 4, in which said housing defines a plurality of symmetrically arranged spring sockets in a common plane parallel to said center plate, and including also a plurality of compression springs seated in said pockets and arranged to bias said release plate resiliently into contact with said center plate, said springs being overcome by cam pressure on said bosses by a hasp inserted into said housing slot.

6. In a child's car safety seat comprising a chair body in which the child sits, a harness anchored to said chair body and adapted to encircle a seated child therein, said harness comprising strap means having opposed free ends, and buckle means for connecting said strap free ends, said buckle means comprising a hasp attached to one strap free end and having a tip defining an opening beyond said strap free end, and a buckle on the opposite strap free end, said buckle comprising a rigid housing adapted to endwise receive said hasp tip, and within said housing parallel to the plane of hasp reception a center plate having a bail portion covered by an extended portion of said housing and attached to said opposite strap, said center plate also having a central aperture beyond said bail with which said hasp tip opening is adapted to register in the assembled relation of said buckle means, a release plate parallel to said center plate and defining a boss adapted to protrude through said center plate aperture and slope-surfaced to readily be received into said hasp opening under spring bias on said release plate to secure said hasp in said buckle housing; and button means carried by said housing to shift said release plate relatively away from said center plate against said spring bias in hasp releasing relation, said housing defining transversely to its extended portion an enlarged shoulder biasing said housing extended portion in plate bail portion separating blocking relation.

7. The child's car safety seat according to claim 6, in which said button is T-shaped, having an enlarged top, housing-defined means surrounding said top against inadvertent depression, and a central leg in contact with said spring biased release plate to be biased against depression thereby in hasp tip passing relation and adjacently spaced relative to said boss.

8. The child's car safety seat according to claim 7, in which said center plate is metal, said housing comprises smooth plastic, said housing extended portion substantially encloses said center plate bail portion against strap fraying contact with said bail, and including also a housing relatively enlarged transverse shoulder adjacent its extended portion blocking separation of said housing portion from said plate bail and thus exposure of said strap to fraying contact.

9. The child's car safety seat according to claim 8, in which said housing comprises matching oppositely recessed molded halves perimetrically engaged and distributively pinned together in center plate securing relation, one of said halves defining a slot into which said hasp tip is receivable, and including also a chamfer on the housing interior wall opposite said slot against contact of said hasp tip with the housing wall in cocking or blocking relation to the release plate boss.

10. The child's car safety seat according to claim 9, including also a plurality of hasp tips having boss-receiving openings, and a corresponding plurality of bosses on said release plate, each sloped to cam said hasp therepast on housing half slot reception.

11. The child's car safety seat according to claim 10, in which said hasp tips are carried on a common hasp.

12. The child's car safety seat according to claim 10, in which said hasp tips are defined by individual, separate hasps attached to respectively different straps for joint entry into said housing slot.

13. The child's car safety seat according to claim 12, in which said hasp tips are acutely angled relative to the remainder of said hasp, and including also a relief at the juncture of said tip and said hasp.

14. The child's car safety seat according to claim 11 or 12, in which said housing defines a plurality of symmetrically arranged spring sockets in a common plane parallel to said center plate, and including also a plurality of compression springs seated in said pockets and arranged to bias said release plate resiliently into contact with said center plate, said springs being overcome by cam pressure on said bosses by a hasp inserted into said housing slot.

* * * * *